US010815830B2

(12) United States Patent
McCaffrey et al.

(10) Patent No.: US 10,815,830 B2
(45) Date of Patent: Oct. 27, 2020

(54) LIGHTWEIGHT TIEROD

(71) Applicant: UNITED TECHNOLOGIES CORPORATION, Farmington, CT (US)

(72) Inventors: Michael G McCaffrey, Windsor, CT (US); Scott D Virkler, Ellington, CT (US); Tuan David Vo, Middletown, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 271 days.

(21) Appl. No.: 15/850,379

(22) Filed: Dec. 21, 2017

(65) Prior Publication Data

US 2019/0195087 A1 Jun. 27, 2019

(51) Int. Cl.

| | |
|---|---|
| ***F01D 25/16*** | (2006.01) |
| ***F01D 25/00*** | (2006.01) |
| ***F01D 25/24*** | (2006.01) |
| *F01D 9/06* | (2006.01) |
| *F01D 25/28* | (2006.01) |

(52) U.S. Cl.

CPC ..... *F01D 25/162* (2013.01); *F01D 25/005* (2013.01); *F01D 25/243* (2013.01); *F01D 9/065* (2013.01); *F01D 25/28* (2013.01); *F05D 2220/32* (2013.01); *F05D 2230/237* (2013.01); *F05D 2300/177* (2013.01)

(58) Field of Classification Search

CPC .... F01D 25/162; F01D 25/243; F01D 25/005; F01D 25/28; F01D 9/065

See application file for complete search history.

(56) References Cited

U.S. PATENT DOCUMENTS

| | | | | |
|---|---|---|---|---|
| 8,511,969 | B2 | 8/2013 | Durocher | |
| 8,770,924 | B2 * | 7/2014 | Beeck | F01D 25/28 415/142 |
| 9,194,252 | B2 * | 11/2015 | Farah | F01D 25/162 |
| 9,316,153 | B2 | 4/2016 | Patat et al. | |
| 9,689,312 | B2 | 6/2017 | Sjoqvist | |
| 9,896,966 | B2 * | 2/2018 | Petty | F01D 25/24 |
| 10,519,860 | B2 * | 12/2019 | Moniz | F01D 1/24 |
| 2010/0275572 | A1 | 11/2010 | Durocher et al. | |
| 2012/0243970 | A1 | 9/2012 | Hellgren et al. | |
| 2013/0011242 | A1 * | 1/2013 | Beeck | F01D 25/30 415/142 |

(Continued)

FOREIGN PATENT DOCUMENTS

| | | |
|---|---|---|
| CN | 106762151 | 5/2017 |

OTHER PUBLICATIONS

European Patent Office, European Search Report dated Apr. 25, 2019 in Application No. 18201543.8.

*Primary Examiner* — Eldon T Brockman
(74) *Attorney, Agent, or Firm* — Snell & Wilmer L.L.P.

(57) ABSTRACT

The present disclosure provides an assembly for a gas turbine engine. The assembly may comprise a tierod, a bearing mounting ring, and a joint coupling the tierod to the bearing mounting ring. The joint may be configured to increase a volume of a bearing compartment on an inner surface of the bearing mounting ring. A coefficient of thermal expansion of the bearing mounting ring may be substantially the same as the coefficient of thermal expansion of the tierod.

20 Claims, 7 Drawing Sheets

(56) References Cited

U.S. PATENT DOCUMENTS

| | | | | |
|---|---|---|---|---|
| 2013/0052006 | A1* | 2/2013 | Petty | F01D 25/28 415/213.1 |
| 2013/0177410 | A1* | 7/2013 | Eleftheriou | F01D 25/24 415/208.1 |
| 2013/0224010 | A1* | 8/2013 | Farah | F01D 9/065 415/209.2 |
| 2015/0260057 | A1 | 9/2015 | Farah et al. | |
| 2015/0345337 | A1* | 12/2015 | Petty | F01D 25/28 415/126 |
| 2016/0153315 | A1 | 6/2016 | Kapustka et al. | |
| 2017/0107856 | A1 | 4/2017 | Lefebvre et al. | |
| 2017/0107857 | A1 | 4/2017 | Lefebvre et al. | |
| 2017/0114666 | A1 | 4/2017 | Lefebvre et al. | |
| 2018/0258858 | A1* | 9/2018 | Moniz | F02C 7/06 |

* cited by examiner

LIGHTWEIGHT TIEROD

GOVERNMENT LICENSE RIGHTS

This disclosure was made with Government support under Contract No. W58RGZ-16-C-0046 awarded by The United States Army. The Government has certain rights in the disclosure.

FIELD OF THE DISCLOSURE

The present disclosure relates to assembly systems and methods, and more particularly, to assembly systems and methods in gas turbine engines.

BACKGROUND OF THE DISCLOSURE

Gas turbine engines typically comprise tierods to provide structural support for various components of the gas turbine engine. In aircraft having smaller sized engines, the loss of volume can negatively impact the engine design and performance. For example, the loss of volume can result in less volume available for other cooling fluid to circulate.

SUMMARY OF THE DISCLOSURE

An assembly for a gas turbine engine may comprise a tierod, a bearing mounting ring, and a joint coupling the tierod to the bearing mounting ring.

In various embodiments, the joint may be a brazed joint. The tierod may comprise a base comprising a flange, a rod extending from the base, and a head opposite the base and extending from the rod. The bearing mounting ring may comprise at least one aperture for receiving the tierod. The joint may be configured to increase a volume of a bearing compartment on an inner surface of the bearing mounting ring. The joint may couple an outer surface of the base flange to an inner surface of the bearing mounting ring. The rod may extend through an aerodynamic fairing. The head may be configured to be mechanically coupled to an annular outer structure. A coefficient of thermal expansion of the bearing mounting ring may be substantially the same as the coefficient of thermal expansion of the tierod. The joint may be configured to decrease a thickness of the base flange. The tierod may comprise a cast nickel alloy.

A gas turbine engine may comprise an annular outer structure, a fairing structure comprising a plurality of aerodynamic fairings, and an assembly comprising a tierod and a bearing mounting ring. The tierod may be coupled to the bearing mounting ring.

In various embodiments, the tierod may be coupled to the bearing mounting ring using a brazing process. The tierod may comprise a base comprising a flange, a rod extending from the base, and a head opposite the base and extending from the rod. The tierod may extend radially from the bearing mounting ring, through the fairing structure, to the annular outer structure. The head of the tierod may be configured to be mechanically coupled to the annular outer structure. A coefficient of thermal expansion of the tierod may be the same as a coefficient of thermal expansion of the bearing mounting ring. Brazing the tierod to the bearing mounting ring may be configured to increase a volume of a bearing compartment.

A method of assembling an assembly of a gas turbine engine may comprise positioning a fairing structure within an annular outer structure. The method may comprise inserting a tierod through a bearing mounting ring. The method may comprise inserting the tierod through the fairing structure. The method may comprise coupling the tierod to the annular outer structure. The method may comprise coupling the tierod to the bearing mounting ring.

In various embodiments, the method may comprise coupling the tierod to the bearing mounting ring utilizing a brazing process.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, electrical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, methods, systems, and articles may find particular use in connection with gas turbine engines. However, various aspects of the disclosed embodiments may be adapted for optimized performance in a variety of engines or other systems. As such, numerous applications of the present disclosure may be realized.

Figure 1:
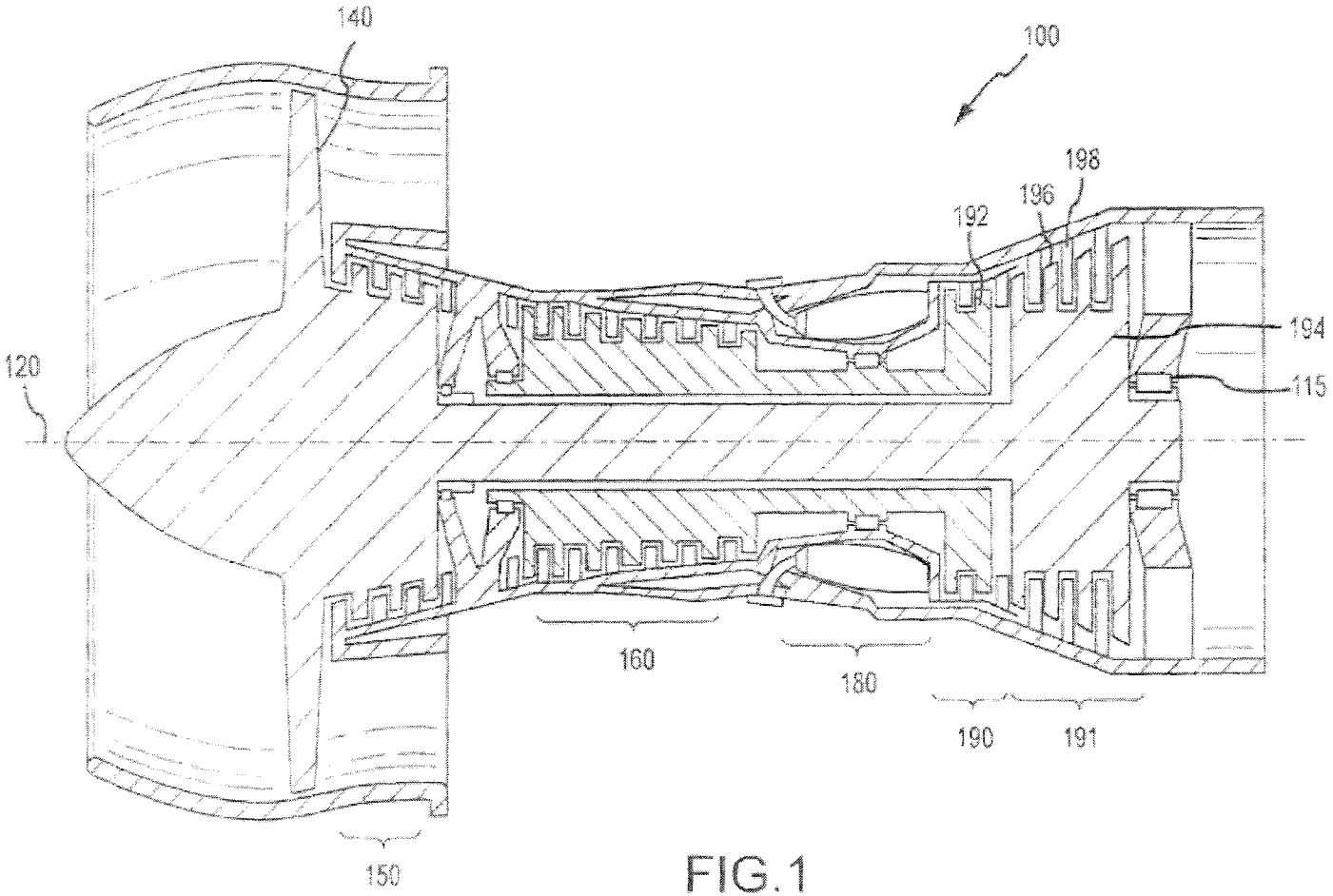
FIG. 1 illustrates a cross-sectional view of a gas turbine engine in accordance with various embodiments.

Referring to FIG. 1, a gas turbine engine 100 (such as a turbofan gas turbine engine) is illustrated according to various embodiments. Gas turbine engine 100 is disposed about axial centerline axis 120, which may also be referred to as axis of rotation 120. Gas turbine engine 100 may comprise a fan 140, compressor sections 150 and 160, a combustion section 180, and turbine sections 190, 191. The fan 140 may drive air into compressor sections 150, 160, which further drive air along a core flow path for compression and communication into the combustion section 180. Air compressed in the compressor sections 150, 160 may be mixed with fuel and burned in combustion section 180 and expanded across the turbine sections 190, 191. The turbine sections 190, 191 may include high pressure rotors 192 and low pressure rotors 194, which rotate in response to the expansion. The turbine sections 190, 191 may comprise alternating rows of rotary airfoils or blades 196 and static airfoils or vanes 198. Cooling air may be supplied to the turbine sections 190, 191 from the compressor sections 150, 160. A plurality of bearings 115 may support spools in the gas turbine engine 100. FIG. 1 provides a general understanding of the sections in a gas turbine engine, and is not intended to limit the disclosure. The present disclosure may extend to all types of applications and to all types of turbine engines, including turbofan gas turbine engines and turbojet engines.

Figure 2A:
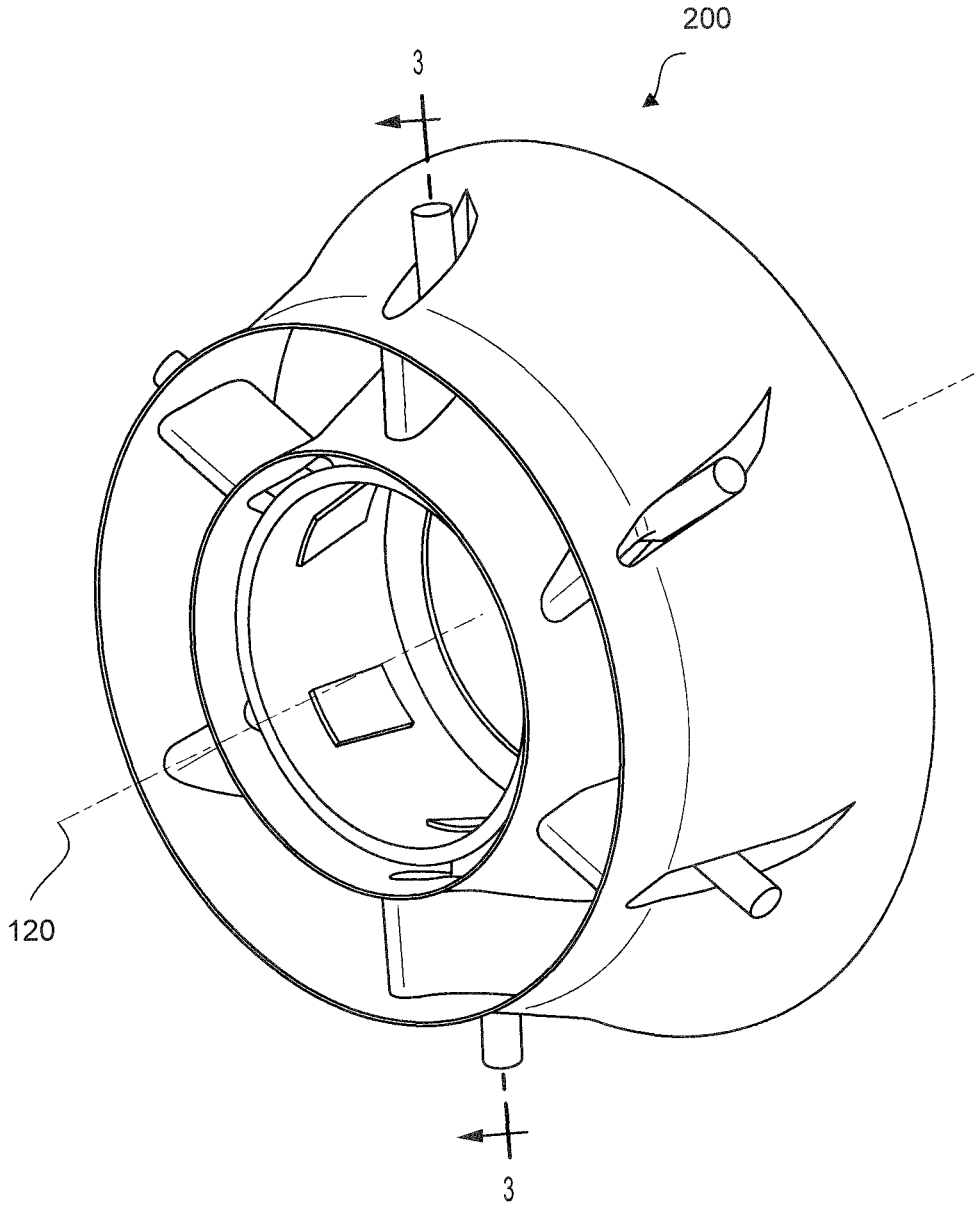
FIGS. 2*a*, 2*b*, and 2*c* illustrate a perspective, cross-sectional, and axial view, respectively, of the assembly in accordance with various embodiments.
Figure 2B:
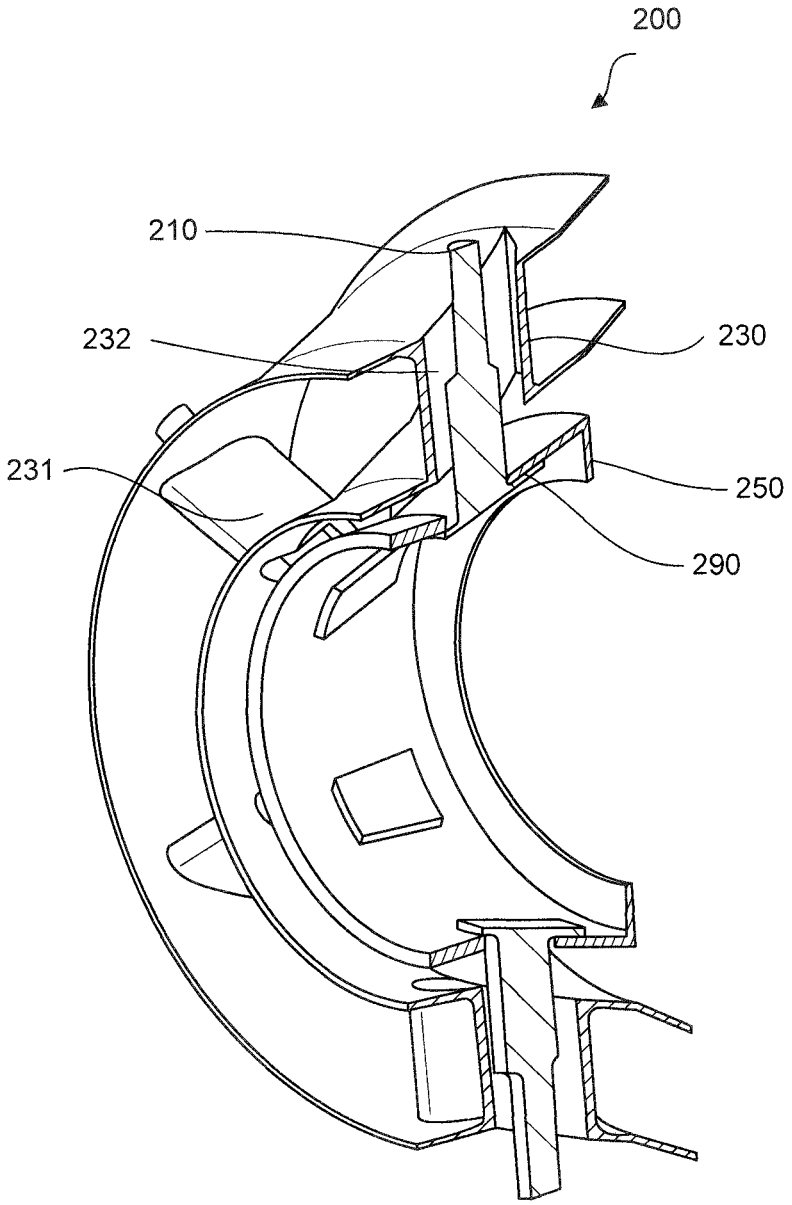
Figure 2C:
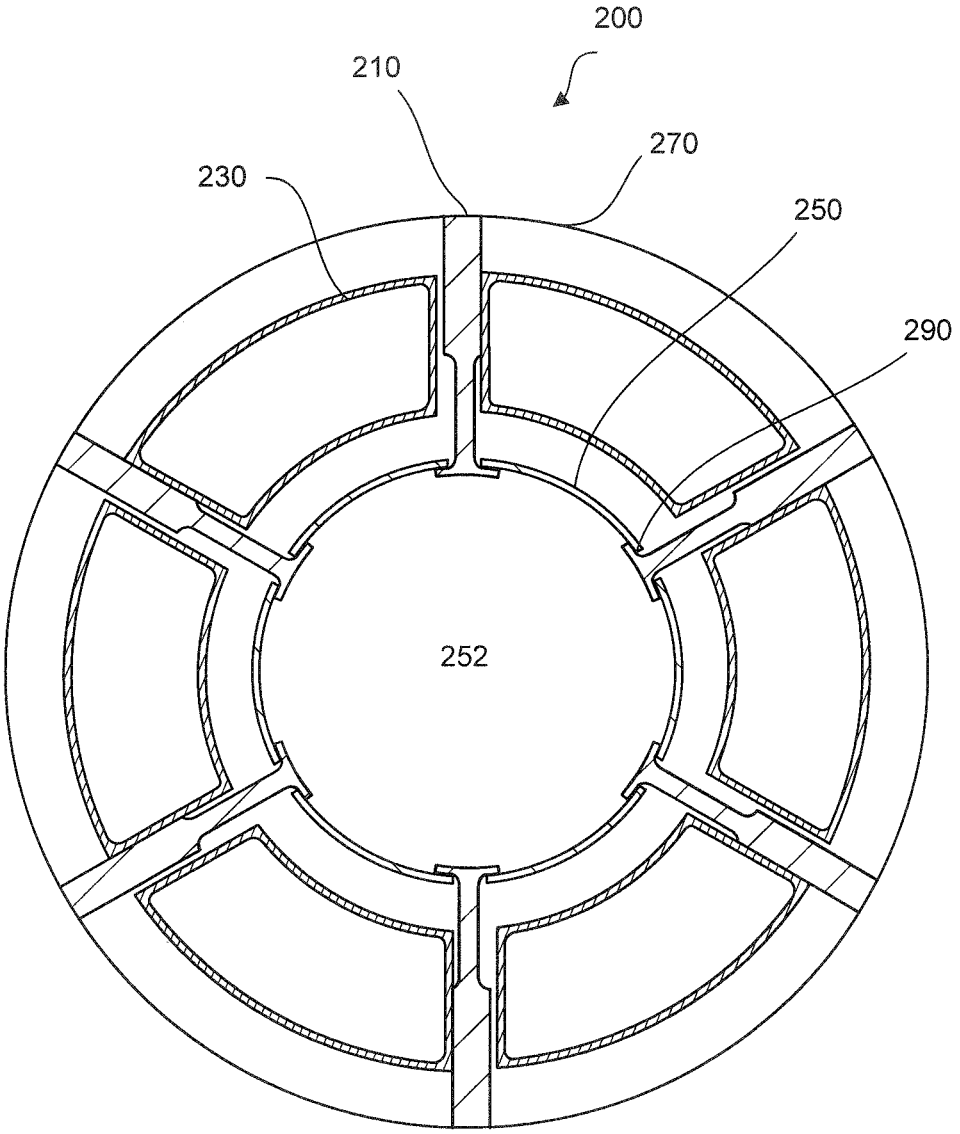

Referring to FIGS. 2*a*-2*c*, according to various embodiments, a schematic diagram of an assembly 200 for gas turbine engine 100 is depicted. Assembly 200 may be situated in a mid-turbine frame situated between turbine sections 190 and 191 of gas turbine engine 100. With reference to FIG. 2*a*, assembly 200 may be disposed about axial centerline axis 120 of gas turbine engine 100.

Referring now to FIGS. 2*b* and 2*c*, FIG. 2*b* depicts a cross-sectional view of assembly 200 along section line 3-3. FIG. 2*c* depicts an axial view of assembly 200. Assembly 200 may comprise tierod 210, fairing structure 230, bearing mounting ring 250, and annular outer structure 270. Fairing structure 230 may comprise a plurality of aerodynamic fairings 231 extending radially within fairing structure 230. The aerodynamic fairings 231 of fairing structure 230 may comprise an aperture 232 configured to receive tierod 210. Tierod 210 may extend radially from bearing mounting ring 250 to annular outer structure 270. As will be discussed in further detail with reference to FIG. 3 and FIG. 4, tierod 210 may be brazed or otherwise coupled to bearing mounting ring 250 and mechanically coupled to annular outer structure 270. Bearing mounting ring 250 may comprise bearing compartment 252 on its inner surface.

Figure 3:
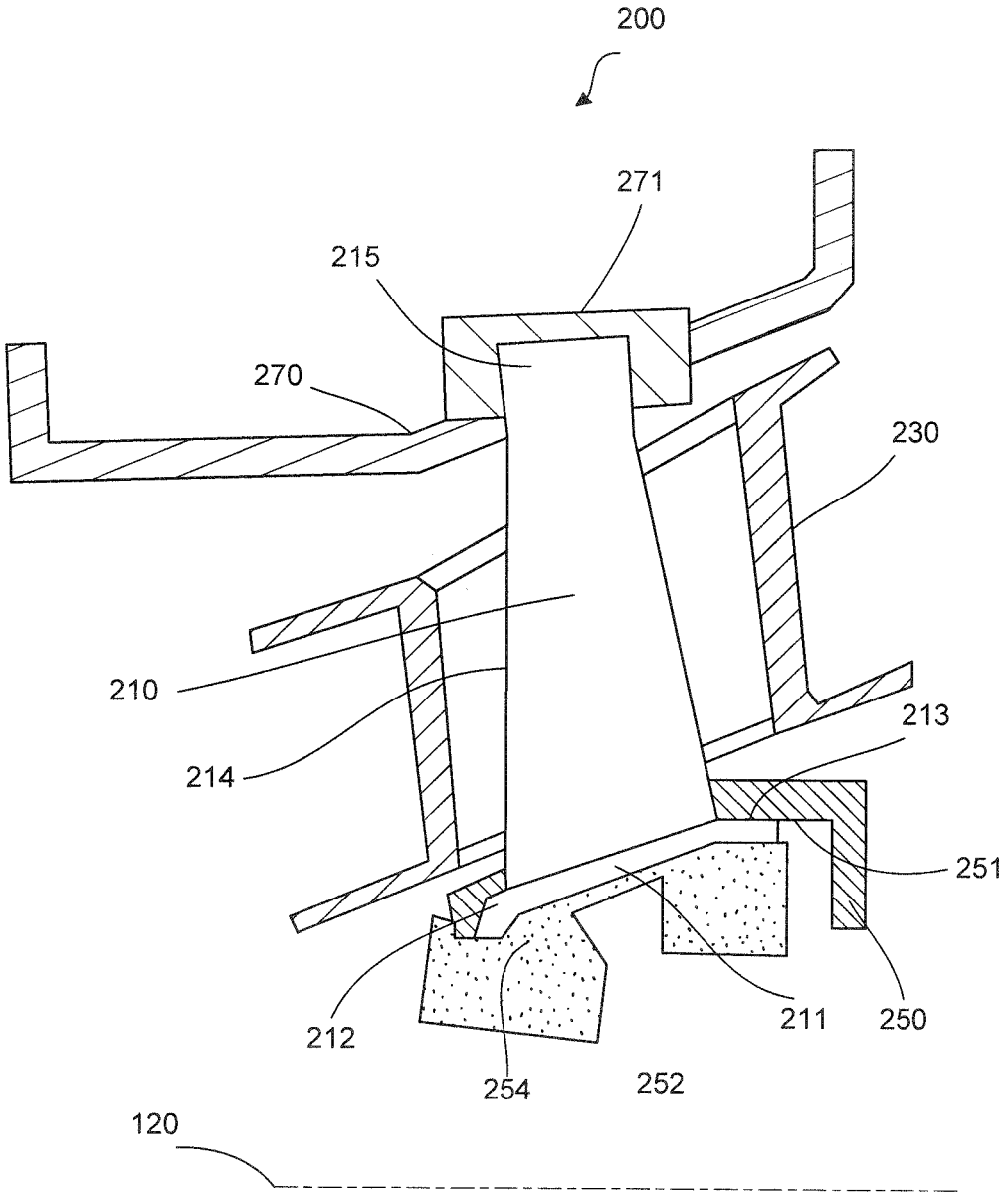
FIG. 3 illustrates an expanded cross-sectional view of the assembly in accordance with various embodiments.

With reference now to FIG. 3, assembly 200 is depicted in greater detail. Tierod 210 may comprise a base 211 comprising a base flange 212. Base flange 212 may extend around an outer portion of base 211, comprising a relatively wider surface area than base 211. The base flange 212 may be integral with base 211. In various embodiments, base flange 212 may be coupled to base 211 by other methods, including but not limited to welding, brazing, and/or sintering. Base flange 212 may also comprise an outer surface 213 configured to be brazed to an inner surface 251 of the bearing mounting ring 250. Tierod 210 may further comprise a rod 214 extending from the base 211 and a head 215 extending from the rod 214 and opposite the base 211. In various embodiments, base 211, rod 214, and head 215 may be integral with each other. In various embodiments, base 211, rod 214, and head 215 may be separate components coupled together.

In various embodiments, tierod 210 may extend through fairing structure 230 and be coupled to the bearing mounting ring 250 and annular outer structure 270. For example, tierod 210 may extend through fairing structure 230 and coupled to annular outer structure 270 utilizing a mechanical coupling. Outer surface 213 of the flange 212 may be brazed to inner surface 251 of bearing mounting ring 250. Outer surface 213 and inner surface 251 may be brazed throughout an entirety of their mating surfaces or a portion of their mating surfaces.

Tierod 210 and bearing mounting ring 250 may be the same or similar materials. For example, tierod 210 and bearing mounting ring 250 may be a cast nickel alloy, a nickel chromium alloy (such as that sold under the mark INCONEL, e.g., INCONEL 600, 617, 625, 718, X-70, and the like) and/or the like. Tierod 210 and bearing mounting ring 250 may have a substantially similar coefficient of thermal expansion (CTE). For example, a CTE of tierod 210 may be within +/−10% of a CTE of bearing mounting ring 250. Tierod 210 and bearing mounting ring 250 comprising materials with substantially similar CTEs allows tierod 210 and bearing mounting ring 250 to expand at similar rates in response to changes in temperature, thereby making structural failure of joints 290 and assembly 200 less likely.

Figure 4:
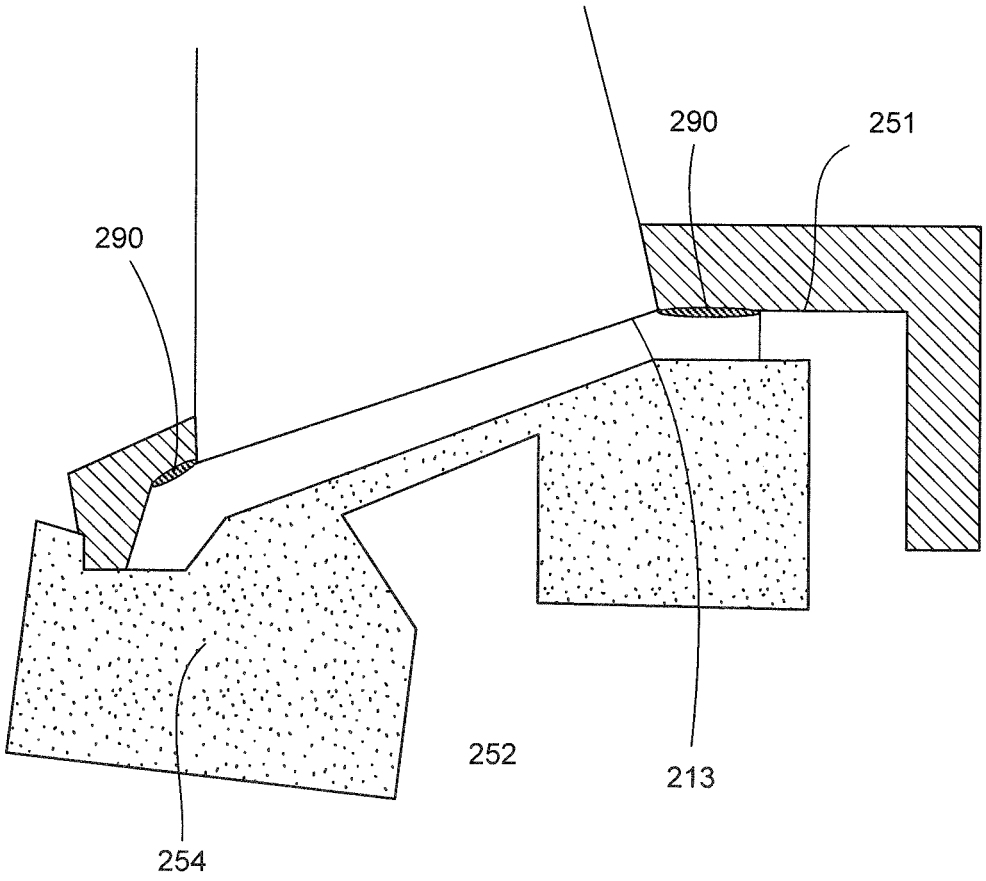
FIG. 4 illustrates an expanded cross-sectional view the assembly of FIG. 3 in accordance with various embodiments.

With reference now to FIG. 4, joints 290 are shown connecting outer surface 213 of flange 212 and inner surface 251 of bearing mounting ring 250. Joints 290 may result from various brazing processes, including but limited to torch brazing, furnace brazing, silver brazing, braze welding, cast iron welding brazing, vacuum brazing, dip brazing, or other brazing techniques. Joints 290 may also result from various other coupling processes including but not limited to welding, diffusion bonding, and/or transient liquid phase bonding. Various materials may be used for brazing of joints 290, including but not limited to nickel-boron pastes, nickel-silicon pastes, nickel-phosphorus pastes, gold pastes or other any other material capable of withstanding high temperatures in the gas turbine engine 100. While joints 290 are shown only between a portion of outer surface 213 and inner surface 251 on flange 212 in FIG. 4, joints 290 are not limited in this regard. Alternative embodiments of assembly 200 may comprise one joint 290 extending an entire length of a mating surface between outer surface 213 and inner surface 251, for example. In this regard, base 211 may be a separate component from rod 214 and joint 290 may couple base 211 to rod 214 and bearing mounting ring 250. Further embodiments may comprise multiple joints 290 along the entire length of the mating surface between outer surface 213 and inner surface 251.

Brazing tierod 210 to bearing mounting ring 250 results in numerous advantages. In this regard, assembly 200 utilizing joints 290 between tierod 210 and bearing mounting ring 250 can limit additional weight to gas turbine engine 100 and limit the occupied space in bearing compartment 252 by reducing a thickness of the flange 212. This allows bearing compartment 252 to better accommodate oil routing components and cooling applications such as oil scavenging, for example. Additional space in bearing compartment 252 can be seen in FIG. 3 and FIG. 4, as indicated by shaded region 254.

Figure 5:
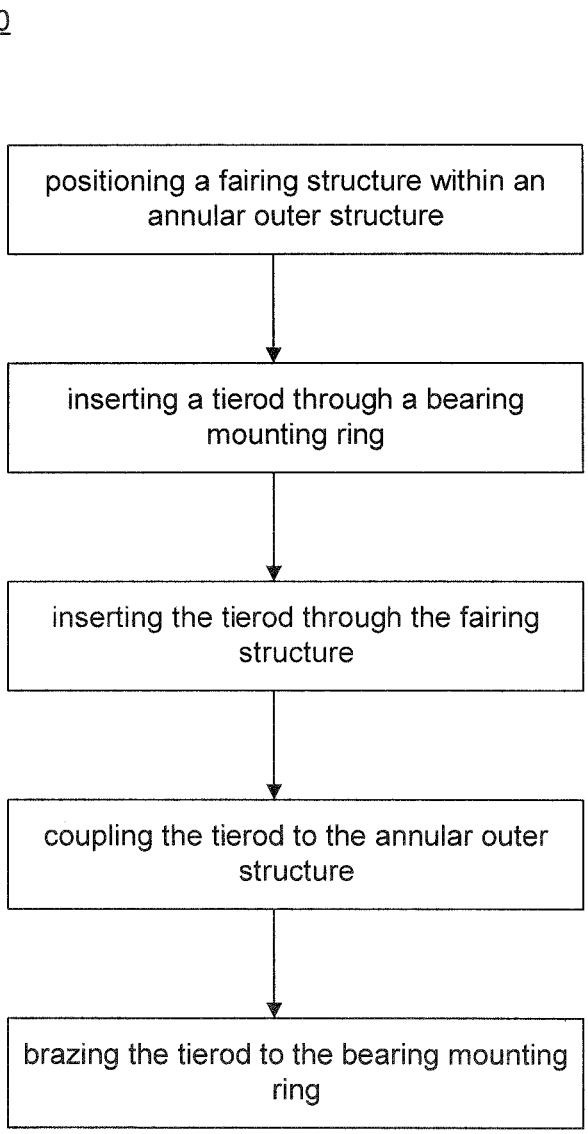
FIG. 5 depicts a flowchart illustrating a method of assembling an assembly of a gas turbine engine in accordance with various embodiments.

A block diagram illustrating a method 500 for assembling a assembly, such as assembly 200, is depicted in FIG. 5, in accordance with various embodiments. Method 500 may comprise positioning a fairing structure within an annular outer structure. Method 500 may further comprise inserting a tierod through a bearing mounting ring. The method may further comprise inserting the tierod through the fairing structure. The method may further comprise coupling the tierod to the annular outer structure and brazing the tierod to the bearing mounting ring. Method 500 is not intended to be limited in this regard. For example, in various embodiments, method 500 may comprise brazing the tierod to the bearing mounting ring prior to coupling the tierod to the annular outer structure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods, systems, and computer-readable media are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An assembly for a gas turbine engine, comprising:

a tierod;

a bearing mounting ring defining a bearing compartment; and a brazed joint located between mating surfaces of the tierod and the bearing mounting ring, wherein the mating surfaces of the tierod and the bearing mounting ring face one another;

wherein the tierod extends through the bearing mounting ring and comprises a flange within the bearing compartment, wherein the brazed joint is between the flange and an inner surface of the bearing mounting ring that defines a boundary of the bearing compartment.

2. The assembly of claim 1, wherein the tierod comprises a base comprising the flange, a rod extending from the base, and a head opposite the base and extending from the rod.

3. The assembly of claim 2, wherein the brazed joint is disposed between and couples an outer surface of the flange to the inner surface of the bearing mounting ring.

4. The assembly of claim 3, wherein the brazed joint is configured to decrease a thickness of the flange.

5. The assembly of claim 2, wherein the rod extends through an aerodynamic fairing, wherein there is a space between an outer surface of the bearing mounting ring and the aerodynamic fairing, and wherein the rod extends through the outer surface of the bearing mounting ring and through the bearing mounting ring to dispose the flange within the bearing compartment.

6. The assembly of claim 2, wherein the head is configured to be mechanically coupled to an annular outer structure.

7. The assembly of claim 1, wherein the bearing mounting ring comprises at least one aperture for receiving the tierod.

8. The assembly of claim 1, wherein the brazed joint is configured to increase a volume of the bearing compartment on the inner surface of the bearing mounting ring.

9. The assembly of claim 1, wherein a coefficient of thermal expansion of the bearing mounting ring is substantially the same as a coefficient of thermal expansion of the tierod.

10. The assembly of claim 1, wherein the tierod comprises a cast nickel alloy.

11. A gas turbine engine, comprising:

an annular outer structure;

a fairing structure comprising a plurality of aerodynamic fairings;

an assembly comprising a tierod and a bearing mounting ring defining a bearing compartment, wherein the tierod extends through the bearing mounting ring and comprises a flange; and a brazed joint between the flange and an inner surface of the bearing mounting ring that defines a boundary of the bearing compartment, wherein the brazed joint is between the inner surface of the bearing mounting ring and a surface of the flange that faces the inner surface of the bearing mounting ring.

12. The gas turbine engine of claim 11, wherein there is a space between an outer surface of the bearing mounting ring and the fairing structure.

13. The gas turbine engine of claim 11, wherein the tierod further comprises a rod extending from a base, and a head opposite the base and extending from the rod, wherein the base comprises the flange.

14. The gas turbine engine of claim 13, wherein the head of the tierod is configured to be mechanically coupled to the annular outer structure.

15. The gas turbine engine of claim 11, wherein the tierod extends radially from the bearing mounting ring, through the fairing structure, to the annular outer structure.

16. The gas turbine engine of claim 11, wherein a coefficient of thermal expansion of the tierod is the same as a coefficient of thermal expansion of the bearing mounting ring.

17. The gas turbine engine of claim 11, wherein the brazed joint is configured to increase a volume of the bearing compartment.

18. A method of assembling an assembly of a gas turbine engine, comprising:

positioning a fairing structure within an annular outer structure;

inserting a tierod through a bearing mounting ring, the tierod comprising a flange comprising an outer surface and the bearing mounting ring comprising an inner surface defining a bearing compartment, wherein the flange is disposed in the bearing compartment;

inserting the tierod through the fairing structure;

coupling the tierod to the annular outer structure; and coupling the outer surface of the flange of the tierod to the inner surface of the bearing mounting ring via a brazed joint this is located between the outer surface of the flange and the inner surface of the bearing mounting ring.

19. An assembly for a gas turbine engine, comprising:

a tierod, wherein the tierod comprises a base comprising a flange, a rod extending from the base, and a head opposite the base and extending from the rod;

a bearing mounting ring defining a bearing compartment; and a brazed joint located between mating surfaces of the tierod and the bearing mounting ring, wherein the mating surfaces of the tierod and the bearing mounting ring face one another, wherein the brazed joint is disposed between and couples an outer surface of the flange to an inner surface of the bearing mounting ring.

20. An assembly for a gas turbine engine, comprising:

a tierod, wherein the tierod comprises a base comprising a flange, a rod extending from the base, and a head opposite the base and extending from the rod;

a bearing mounting ring defining a bearing compartment; and a brazed joint located between mating surfaces of the tierod and the bearing mounting ring, wherein the mating surfaces of the tierod and the bearing mounting ring face one another;

wherein the rod extends through an aerodynamic fairing, wherein there is a space between an outer surface of the bearing mounting ring and the aerodynamic fairing, wherein the rod extends through the outer surface of the bearing mounting ring and through the bearing mounting ring to dispose the flange within the bearing compartment, and wherein the brazed joint is between the flange and an inner surface of the bearing mounting ring that defines a boundary of the bearing compartment.

* * * * *